US005407371A

United States Patent [19]

Chen

[11] Patent Number: 5,407,371

[45] Date of Patent: Apr. 18, 1995

[54] CONNECTOR CONTACT MOUNTING HARDWARE

[76] Inventor: Tsai-Fu Chen, No. 12, Lane 83, Hwa Chen Road, Hsin Chuang City, Taipei Hsien, Taiwan, Prov. of China

[21] Appl. No.: 165,924

[22] Filed: Dec. 14, 1993

[51] Int. Cl.[6] ..... H01R 13/02

[52] U.S. Cl. ..... 439/886; 439/874; 439/877; 439/882

[58] Field of Search ..... 439/874, 877, 883, 886, 439/507, 511, 525, 59, 68, 70, 78

[56] References Cited

U.S. PATENT DOCUMENTS 3,670,298 6/1972 Klumpp, Jr. ..... 439/877
3,841,472 10/1974 Fuller et al. ..... 206/329
4,182,928 1/1980 Murphy et al. ..... 29/882
4,717,354 1/1988 McCleery ..... 439/874
5,263,880 11/1993 Schwarz et al. ..... 439/79

*Primary Examiner*—Z. R. Bilinsky
*Attorney, Agent, or Firm*—Varndell Legal Group

[57] ABSTRACT

A connector contact mounting hardware includes an elongated strip of contact holder frame having pairs of notched upright wings on two opposite sides, and a plurality of contacts respectively made of a round wire rod and retained in respective retaining notches on either pair of upright wings, each contact having a front contact body extended out of either upright wing on one side for plating with gold, a notched tail extended out of a corresponding upright wing on an opposite side for plating with tin and for mounting a conductor, and a dovetial-like lower portion between the front contact body and the notched tail.

12 Claims, 8 Drawing Sheets

CONNECTOR CONTACT MOUNTING HARDWARE

BACKGROUND AND SUMMARY OF THE INVENTION

The present invention relates to a connector contact mounting hardware which permits the front ends and tails of the contacts being retained in a contact holder frame to be separately plated with gold or tin.

The connector of a keyboard or mouse, as shown in FIG. 1, is generally comprised of a cylindrical casing, a plurality of contacts fastened to a core mounted within the cylindrical casing. The contacts are internally standardized having a respective front contact end in diameter 0.6 mm. When the contacts are made, they must be electroplated with gold, silver, tin, etc., and then connected to a respective conductor through a tin soldering process. FIG. 2 shows a contact individually made according to the prior art, having a conical projection around the periphery thereof near the tail for positioning in a repsective hole on the core of a connector. The maximum diameter of the conical projection is 1.25 mm. This structure of contact is made through a lathe work, much material loss will happen during the processing process. As it is individually made, it must be gold plated completely. Therefore, this structure of contact is expensive to manufacture. As the contact is made through a lathe work, tracks of the tool of the lathe will be left on the contact surface of the contact. Therefore, gaps will be existed between the contacts when two connectors are connected, causing the impedance increased. The precision prescribed of this structure of contact is ±0.03 mm. This broad tolerance cannot achieve a high quality transmission. Furthermore, because of the design of the conical projection, the insulation distance between the conical projections of two adjacent contacts in a connector is relatively reduced (see FIG. 3), and therefore the transmission of the connector may be interfered by external magnetic noises easily. A yet further drawback of this structure of contact is that it is not suitable for mass production.

FIG. 4A and 4B show another structure of contacts. The contacts are made from a sheet material through a punching process. As the contacts are punched into a respective hollow cylindrical configuration, they may be broken easily during the installation process. Another drawback of these contacts is that their poor roundness greatly increase contact friction, causing their service lift shortened and the impedance increased. The precision prescribed of this structure of contacts is also defined within ±0.03 mm.

The present invention has been accomplished under the aforesaid circumstances. It is therefore an object of the present invention to provide contacts for a computer connector which produce low impedance. It is another object of the present invention to provide contacts for a computer connector which are durable in use. It is still another object of the present invention to provide contacts for a computer connector which are inexpensive to manufacture. It is still another object of the present invention to provide a connector contact mounting hardware which is suitable for mass production. It is still another object of the present invention to provide a connector contact mounting hardware which improves the transmission quality of a computer connector.

According to the present invention, the connector contact mounting hardware comprises an elongated strip of contact holder frame having pairs of notched upright wings on two opposite sides, and a plurality of contacts respectively made of a round wire rod and retained in respective retaining notches on either pair of upright wings, each contact having a front contact body extended out of either upright wing on one side for plating with gold, a notched tail extended out of a corresponding upright wing on an opposite side for plating with tin and for mounting a connector, and a dovetail-like lower portion between the front contact body and the notched tail. As the two opposite ends of the contacts can be selectively and respectively plated with gold or tin, the consumption of gold is relatively reduced, and therefore the electroplating cost is greatly reduces. As the contacts are respectively made of a round wire rod, the roundness of the contacts is high, and the precision prescribed can be controlled within 0.01 mm.

DETAILED DESCRIPTION OF THE PREFERRED EMBODIMENT

Figure 1:
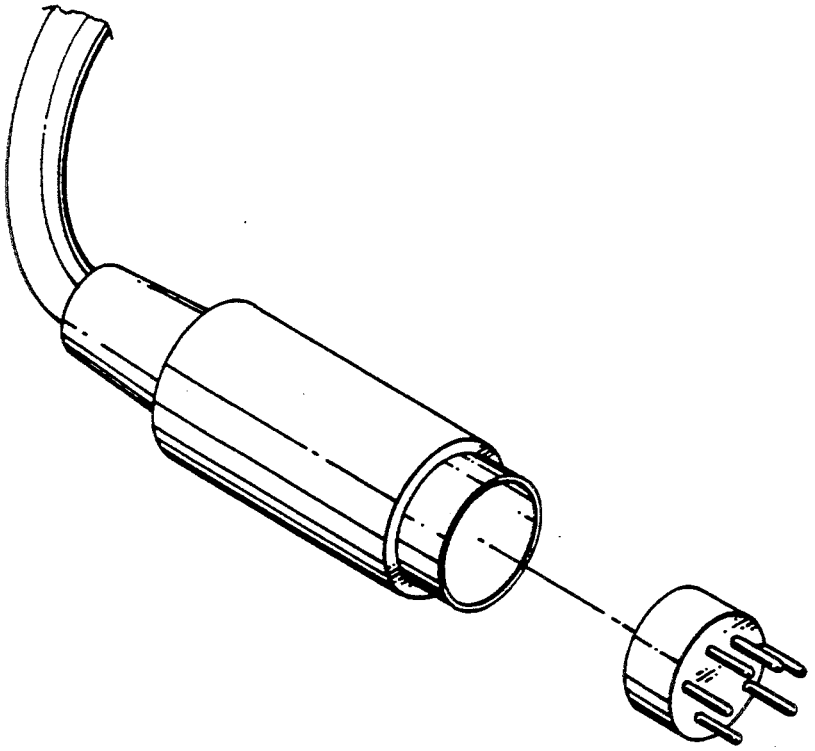
Fig. 1 PRIOR ART
FIG. 1 is an exploded view of a connector for a computer input device.
Figure 2:
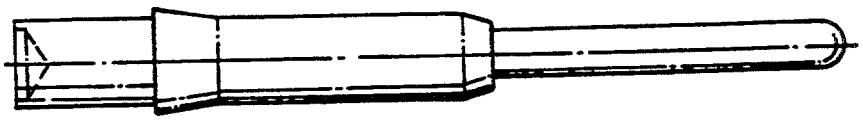
Fig. 2 PRIOR ART
FIG. 2 is a plain view of a contact made through a lathe work according to the prior art.
Figure 3:
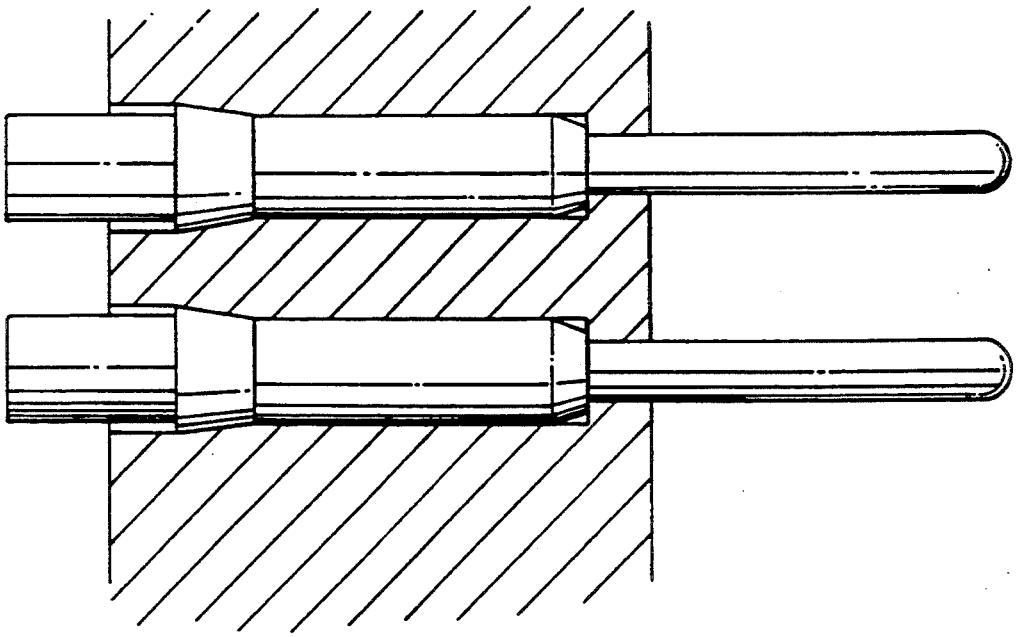
Fig. 3 PRIOR ART
FIG. 3 is a secional view showing two contacts mounted within a core according to the prior art.
Figure 4A:
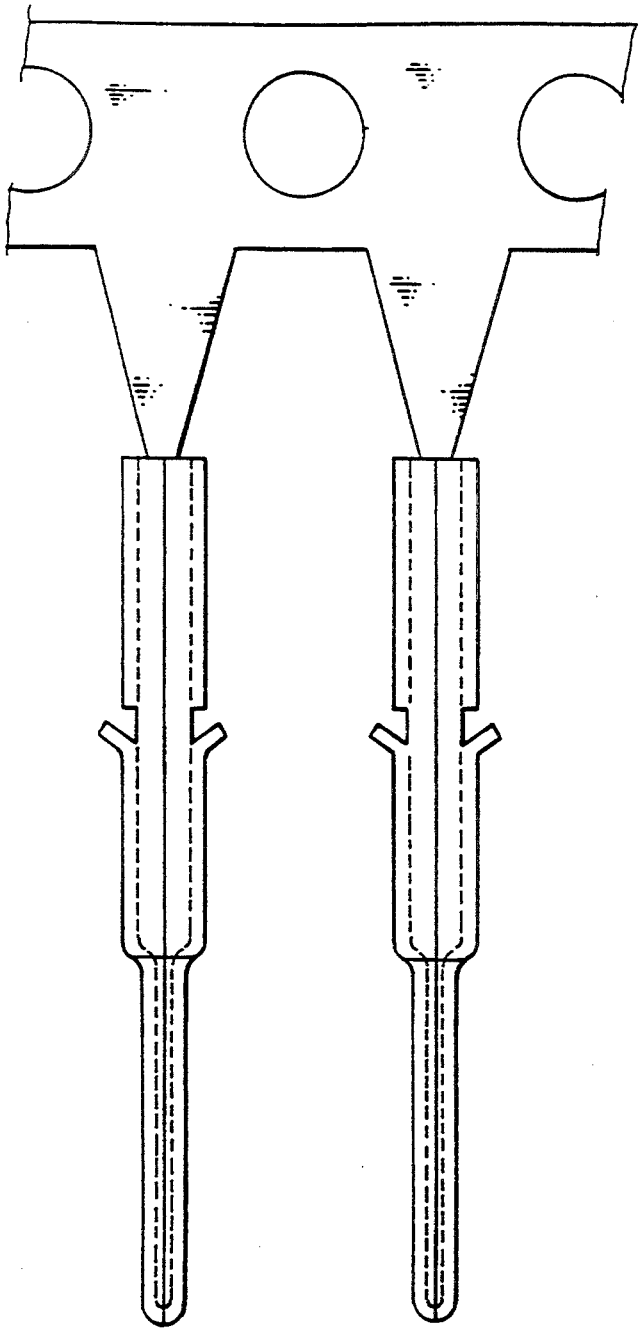
Fig. 4A PRIOR ART
FIG. 4A shows a series of contacts punched from a sheet material according to the prior art.
Figure 4B:
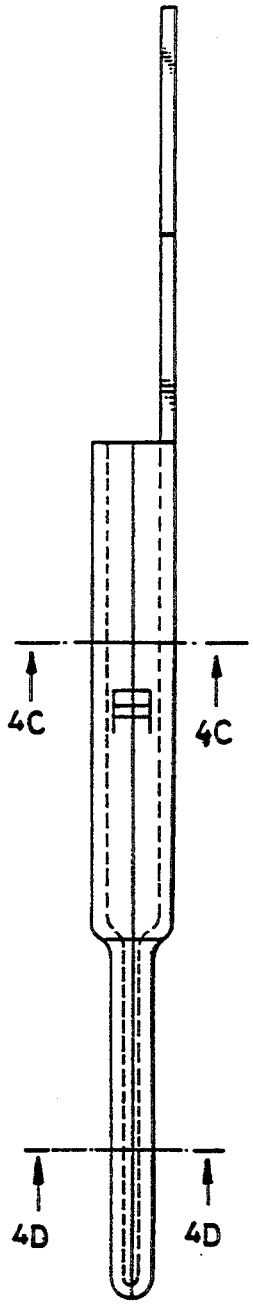
Fig. 4B PRIOR ART
FIG. 4B is a side view taken on FIG. 4A.
Figure 4C:
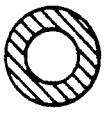
Fig. 4C PRIOR ART
FIG. 4C and 4D is a sectional view taken on line 4C—4C and 4D—4D of FIG. 4B.
Figure 4D:
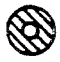
Fig 4D PRIOR ART
Figure 6D:
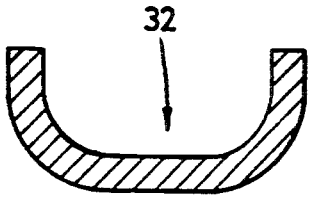
FIG. 6D is a cross section taken along line 6D—6D of FIG. 6A.
Figure 5:
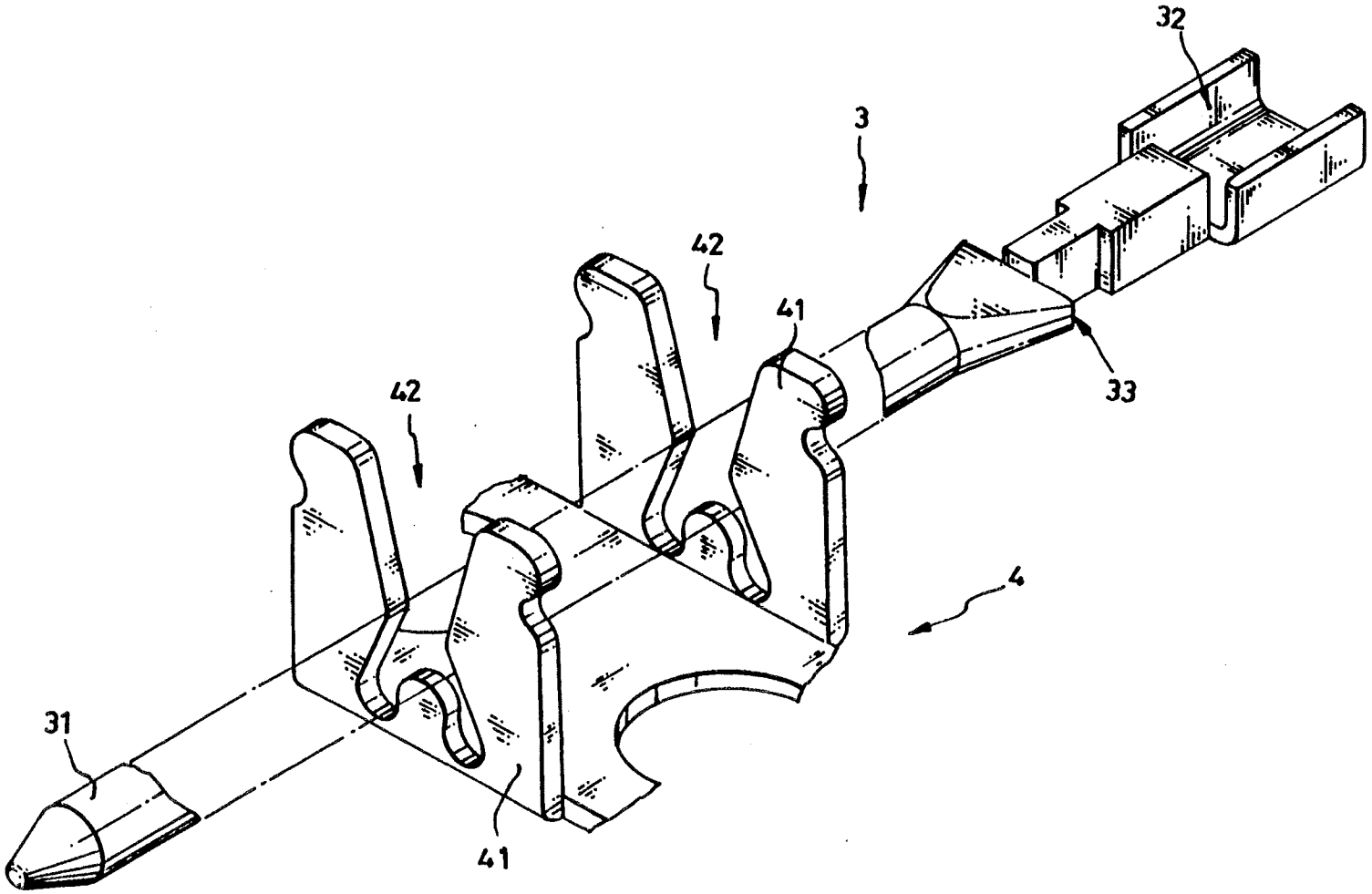
FIG. 5 is a perspective view of a connector contact mounting hardware according to the preferred embodiment of the present invention.
Figure 6A:
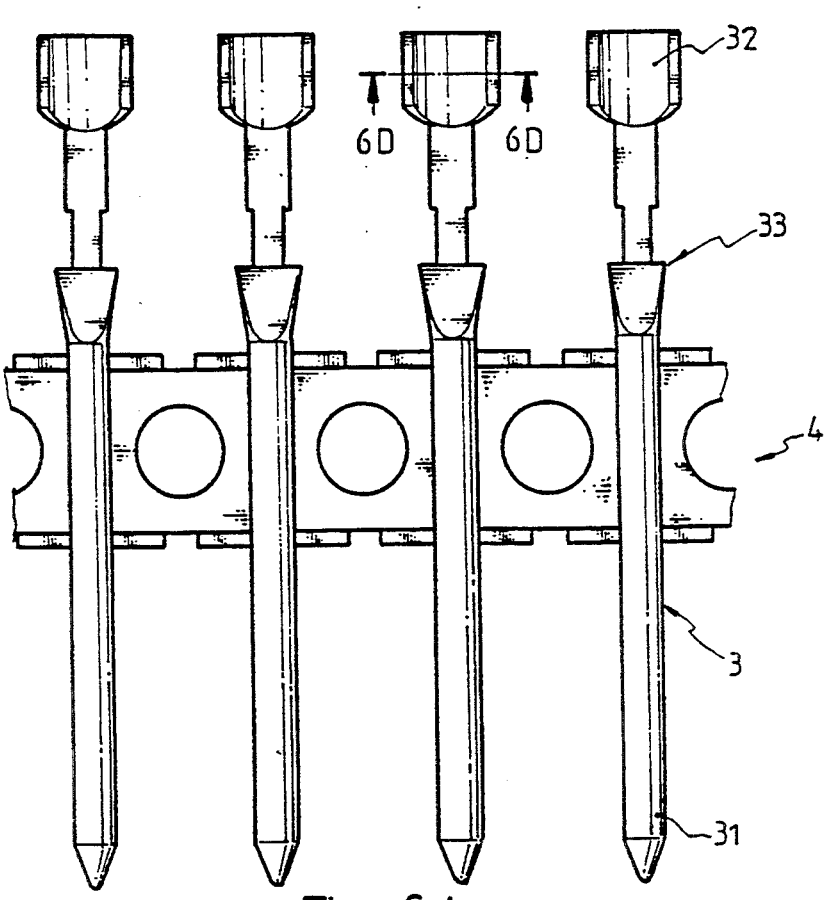
FIG. 6A is a front plain view of the connector contact mounting hardware of the preferred embodiment of the present invention.
Figure 6B:
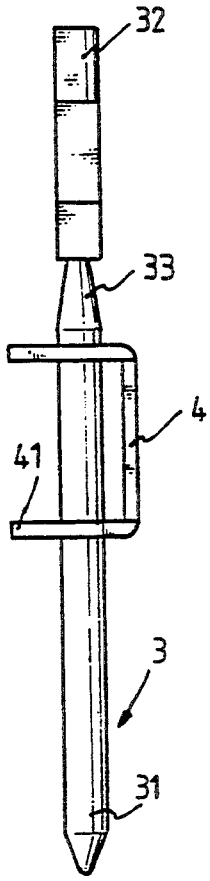
FIG. 6B is a side plain view of the connector contact mounting hardware of the preferred embodiment of the present invention.
Figure 6C:
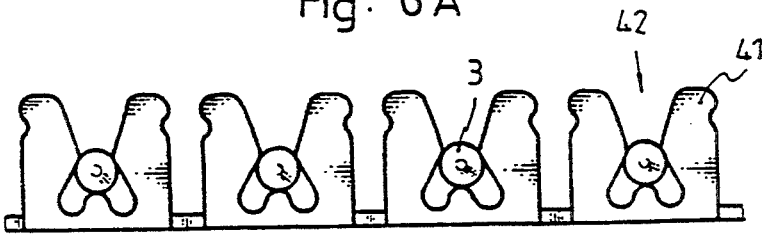
FIG. 6C is an end view of the connector contact mounting hardware of the preferred embodiment of the present invention.

Referring to FIG. 5, a contact 3 is directly made from a round wire rod of diameter 0.6 mm and shape formed through a punching process, having a front contact body 31 maintained in diameter 0.6 mm, a notched tail 32, and a dovetail-like lower portion 33 between the front contact body 31 and the notched tail 32. The notched tail 32 is provided for welding a respective conductor conveniently. It may be made in any of a variety of shapes. In FIG. 5, the notched tail 32 is made in the shape of a U-channel. Of course, the notched tail 32 may be made having a half-round or V-shaped groove in the longitudinal direction for mounting a respective conductor. In another alternate form as shown in FIG. 7, the tail 32' of the contact 3 is made of flat shape having a circular center hole 321' for mounting a conductor.

Referring to FIG. 5 again, there is provided a contact holder frame 4 made from a sheet material through a punching process, having pairs of upright wings 41 symmetrically disposed on two opposite sides, each upright wings 41 defining a retaining notch 42 for positioning a contact 3 between either pair of upright wings 41.

Referring to FIGS. 6A, 6B, 6C, and 6D, a plurality of contacts 3 are respectively retained between the retaining notches 42 on either pair of upright wings 41 of a contact holder frame 4. Because the front contact body 31 is provided for the junction of two electric conductors, the front end of the contact 3 must be gold plated to achieve high conductivity. Because the notched tail 32 is provided for connecting a conductor through a tin soldering process, the rear end of the contact 3 must be tinned. The arrangement of the contact holder frame 4 permits the front contact bodies 31 and the notched tails 32 of the contacts 3 being retained in the retaining notches 42 thereof to be separately and conveneintly plated with gold or tin.

Figure 7:
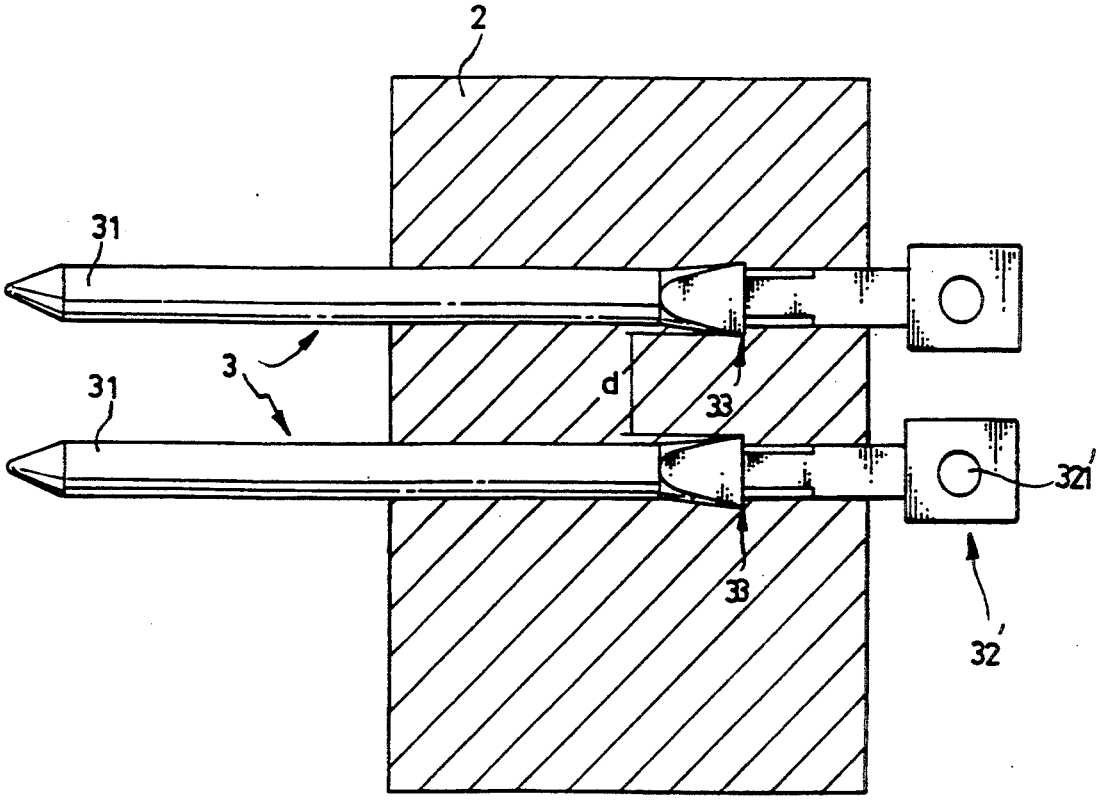
FIG. 7 is a sectional view showing two contacts fastened to a core according to the present invention.

Referring to FIG. 7, therein shown two contacts 3 retained in a circular core 2. The dovetail-like lower portion 33 prohibits the respective contact 3 from being moved backwards once it was fastened to the core 2. The diameter (namely, the maximum width) of the dovetail-like lower portion 33 on each contact 3 is about 0.8 mm, therefore the minimum insulation distance "d" is relatively extended, and the interference of magnetic noises is relatively reduced.

Figure 8:
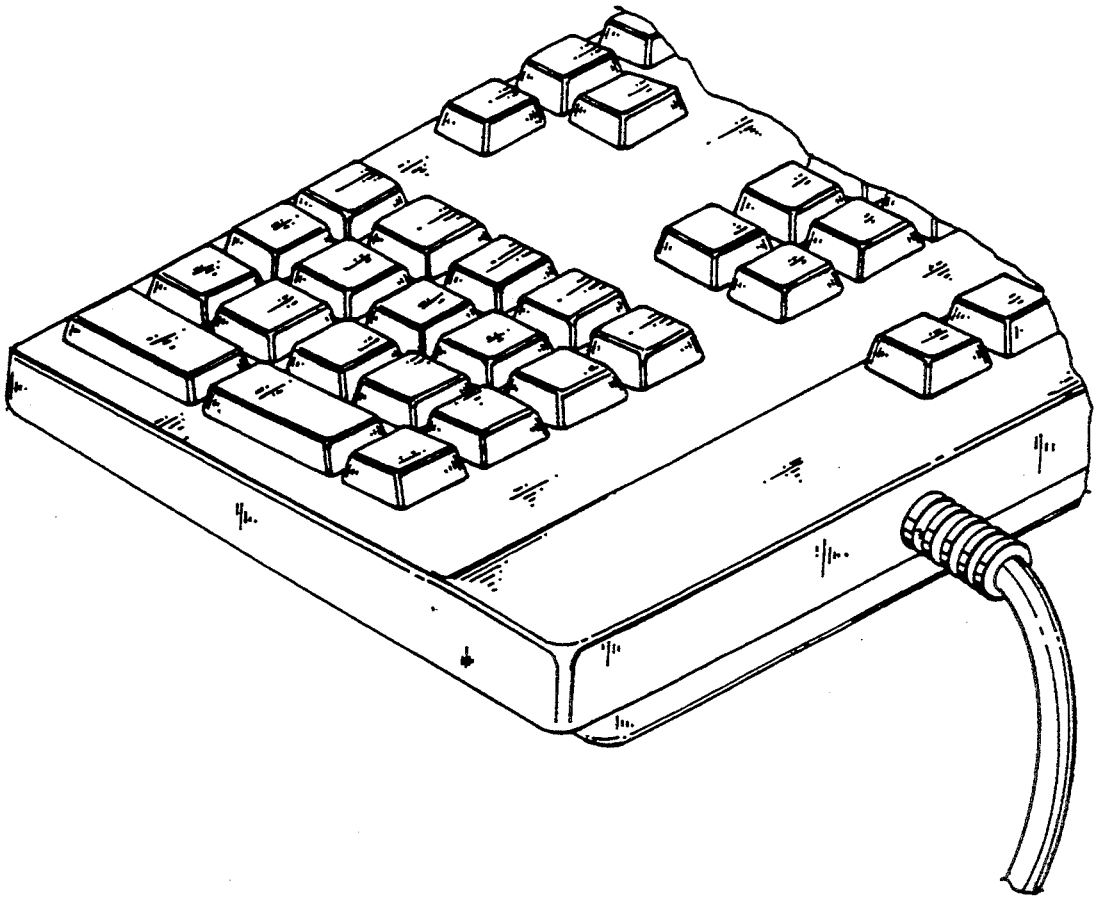
FIG. 8 shown a keyboard connector made according to the present invention.
Figure 8:
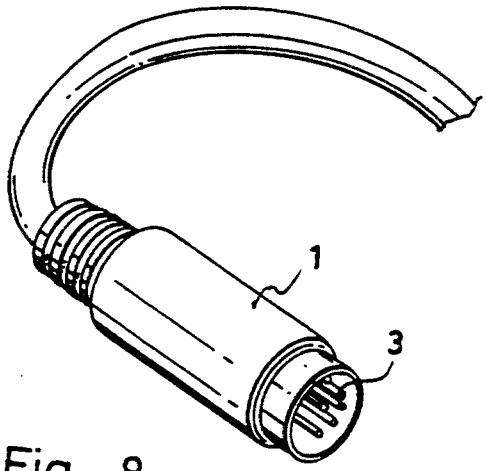

FIG. 8 shows a keyboard connector 1 having contacts 3 made according to the present ivnention. As the contacts are respectively made from a round wire rod which is obtained through an extrusion process, they are strong in structure and have high roundness, and the precision prescribed can be controlled within ±0.01 mm. When electrically connected, the contacts 3 produce low impedance.

I claim:

1. A connector contact mounting hardware comprising a contact holder frame in the shape of an elongated strip, said contact holder frame having pairs of symmetrical upright wings arranged on opposite sides of said contact holder frame, said upright wings each having a solid portion and a retaining notch with a center, said solid portion and said retaining notch shaped so that three projections of said solid portion project toward said center of said retaining notch for holding and receiving a contact therebetween, a plurality of said contacts made of round wire rod respectively retained in said pairs of upright wings, each said contact having a front contact body portion extending outwardly from one upright wing of a respective pair of said upright wings, a notched tail extending outwardly from another upright wing of said respective pair of said upright wings, and a dovetail-shaped portion arranged between said front contact body and said notched tail.

2. The connector contact mounting hardware of claim 1, wherein said notched tail of said contact has the shape of a U-shaped channel longitudinally linked to said dovetail-shaped portion.

3. The connector contact mounting hardware of claim 1, wherein said notched tail of said contact comprises a tail body defining a half-round groove longitudinally aligned with said dovetail-shaped portion and said front contact body.

4. The connector contact mounting hardware of claim 1, wherein said notched tail of said contact comprises a tail body defining a V-shaped groove longitudinally aligned with said dovetail-shaped portion and said front contact body.

5. The connector contact mounting hardware of claim 1, wherein said notched tall of said contact is made of a flat shaped having a circular hole.

6. The connector contact mounting hardware of claim 1, wherein said front contact body portion of said contact is gold plated and said notched tail of said contact is tin plated.

7. A connector contact mounting hardware comprising a contact holder frame in the shape of an elongated strip, said contact holder frame having pairs of symmetrical upright wings arranged on opposite sides of said contact holder frame, said upright wings each having a retaining notch with a center, said retaining notch including side walls having an obtuse angle with an apex thereof facing said center and an inverted U-shaped bottom with a top thereof facing said center, said apexes of said side walls and said top of said inverted U-shaped bottom receiving and holding a contact therebetween, a plurality of said contacts made of round wire rod respectively retained in said pairs of upright wings, each said contact having a front contact body portion extending outwardly from one upright wing of a respective pair of said upright wings, a notched tail extending outwardly from another upright wing of said respective pair of said upright wings, and a dovetail-shaped portion arranged between said front contact body and said notched tail.

8. The connector contact mounting hardware of claim 7, wherein said notched tall of said contact has the shape of a U-shaped channel longitudinally linked to said dovetail-shaped portion.

9. The connector contact mounting hardware of claim 7, wherein said notched tail of said contact comprises a tail body defining a half-round groove longitudinally aligned with said dovetail-shaped portion and said front contact body.

10. The connector contact mounting hardware of claim 7, wherein said notched tail of said contact comprises a tail body defining a V-shaped groove longitudinally aligned with said dovetail-shaped portion and said front contact body.

11. The connector contact mounting hardware of claim 7, wherein said notched tail of said contact is made of a flat shaped having a circular hole.

12. The connector contact mounting hardware of claim 7, wherein said front contact body portion of said contact is gold plated and said notched tail of said contact is tin plated.

* * * * *